US005267603A

United States Patent [19]

Didion

[11] Patent Number: 5,267,603

[45] Date of Patent: Dec. 7, 1993

[54] SAND RECLAIMING DRUM WITH MEDIA RECYCLER

[75] Inventor: Charles J. Didion, St. Charles, Mo.

[73] Assignee: Didion Manufacturing Company, St. Peters, Mo.

[21] Appl. No.: 5,441

[22] Filed: Jan. 19, 1993

[51] Int. Cl.[5] ..... B22D 29/00

[52] U.S. Cl. ..... 164/404; 164/5; 241/74; 241/79.3; 241/DIG. 10

[58] Field of Search ..... 164/404, 5; 241/DIG. 10, 79.3, 74

[56] References Cited

U.S. PATENT DOCUMENTS

| | | | |
|---|---|---|---|
| 4,050,635 | 9/1977 | Mueller et al. | 241/DIG. 10 X |
| 4,211,274 | 7/1980 | Slowinski et al. | 241/DIG. 10 X |
| 4,674,691 | 6/1987 | Didion | 241/DIG. 10 X |
| 5,095,968 | 3/1992 | Didion | 164/404 |

FOREIGN PATENT DOCUMENTS

| | | | |
|---|---|---|---|
| 0066931 | 12/1982 | European Pat. Off. | 164/404 |
| 53-129120 | 11/1978 | Japan | 164/5 |
| 58-84667 | 5/1983 | Japan | 164/5 |
| 58-86970 | 5/1983 | Japan | 164/5 |

*Primary Examiner*—J. Reed Batten, Jr.
*Attorney, Agent, or Firm*—Paul M. Denk

[57] ABSTRACT

The drum incorporates an inner and outer cylinder, having a helical vane located intermediate thereof, with the media drum being supported upon a base and rotated by a drive motor. The drum contains two parts, an entrance segment and an exit segment. At the exit segment, reclaiming media and sand passes into the space between the inner and outer cylinders and is carried to the entrance segment by the helical vanes. At the entrance segment, the media is picked up by a reclaimer which reintroduces the media into the reclaimer to recycle the media.

7 Claims, 1 Drawing Sheet

SAND RECLAIMING DRUM WITH MEDIA RECYCLER

BACKGROUND OF THE INVENTION

This invention relates to improvements embodied in a casting shake-out unit wherein green sand and core and cling sand are separated from molded castings, and in particular, to a sand reclaiming drum which recirculates and recycles the shake-out media.

There are a variety of apparatuses available for aiding in the separation of embedded core and cling sand that holds onto and remains within a casting after it is molded. These devices eliminate the need for a laborer to spend excessive hours cleaning the casting by hand. Such devices are readily shown in my earlier U.S. Patents, for example, U.S. Pat. Nos. 3,998,262, 4,674,691, 4,981,581, 5,016,827, and 5,095,968, all of which are incorporated herein by reference. These patents disclose casting shake-out units used to remove casting sand from a formed casting by tumbling the casting in the presence of abrasive members. These abrasive members, or media, also aid in the deburring of the casting. All these units, as disclosed in the patents, operate very successfully to clean and debur castings. They have saved foundries many hours of hand labor that were previously required in the processing of fresh castings, and have been extensively commercially accepted.

SUMMARY OF THE INVENTION

A principal object of this invention is to provide a rotary media drum to treat castings and to separate residue sand from the castings.

A further object is to provide means for recirculating abrasive media used to separate residue sand from the casting for further use.

These and other objects will become apparent to those skilled in the art upon a review of the following disclosure in light of the accompanying drawing.

In accordance with the invention, generally stated, a rotary media drum is provided which separates surface disposed core sand from fresh castings by tumbling the castings in the presence of abrasive media. The drum includes an outer cylinder and an inner cylinder concentric with the outer cylinder, a series of helically arranged vanes are provided within the space between the two cylinders. The drum is defined by two segments, an entrance segment wherein the surface disposed mold sand is removed from the castings by tumbling and an exit segment through which cleaned castings exit the drum. The entrance segment defines an entrance to the drum and includes rifling for moving the castings longitudinally therealong. The surface of the inner cylinder has a plurality of openings through which removed sand may pass. The exit segment defines a series of openings in its inner cylinder which allow for the passage of the abrasive members and any residue loosened sand from the castings to the space between the two cylinders. Means, in the exit segment, is provided in the space defined by the said two cylinders, for moving the separated sand and abrasive members towards the space between the cylinders within and towards the entrance segment. An inclined member is sloped to direct the sand and abrasive media towards the spacing containing the helical vanes between the cylinders within the entrance segment. The helical vanes within the first segment then urge the sand and abrasive media back towards the entrance.

At the entrance, the drum includes an annular wheel at said entrance which rotates with said drum. The annular wheel has a plurality of spaced paddles which receive the abrasive particles and lift them upwardly to reintroduce them into said drum.

The rotary drum also includes a substantial separator for separating the sand from the abrasive media. The sand/media separator includes a screen formed in the outer cylinder at the entrance segment. The screen includes a series of perforations sized to allow passage of only said sand.

DESCRIPTION OF THE PREFERRED EMBODIMENT

Figure 1:
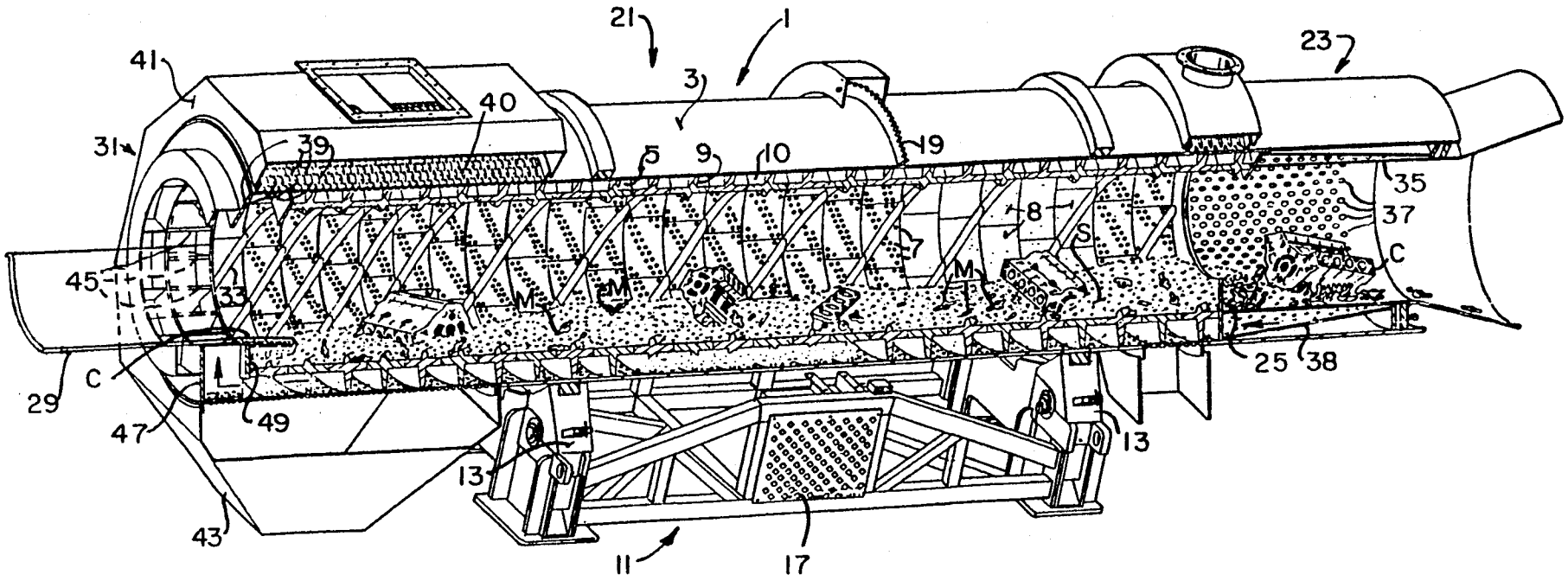
FIG. 1 is a longitudinal cross-sectional view of a sand reclaiming drum of the present invention.

Referring now to FIG. 1, a rotary drum 1 of this invention is disclosed. Drum 1 incorporates an outer cylinder 3 having an inner cylinder 5 arranged concentrically and inwardly thereof. Cylinder 5, as can be seen, has perforations 7 and is formed of segmented modular components 8 that are sectionalized and fitted together to form the liner of the inner cylinder. A helical vane 9 is positioned in the space 10 between cylinders 3 and 5.

The rotary drum is mounted on a base 11 having a pair of bearing means 13 which support the rotary drum during its rotation. In addition, a drive means, generally at 17, cooperates with a sprocket 19 of drum 1 for attaining a controlled rotation of the drum, during its use.

The media drum is generally formed of two segments, one comprising an entrance segment, generally shown at 21, which is integral with the second segment, an exit segment, generally shown at 23. The two segments are separated by a dam 25.

A chute 29 delivers castings C into the entrance 31 of entrance segment 21. In the entrance segment 21, the castings are tumbled as the drum rotates and are urged towards exit segment 23 by rifling 33 formed on inner cylinder 5. In this segment, the castings are subjected to the effects of media or abrasive members M for removing not only core and cling sand S from the casting, but also for deburring the castings. Some of the sand S which is separated from the casting C in entrance segment 21 falls through perforations 7 into the space 10 between the inner and outer cylinders. Perforations 7 are sized to allow sand S, but not members M, to fall therethrough.

The exit segment 23 likewise includes an inner cylinder 35 which has a plurality of apertures 37 therethrough. Apertures 37 are sized to allow members M to pass therethrough. While the castings are moved along the rotary drum in exit segment 23, the remaining residue sand, and any abrading elements falling through apertures 37.

A reversely inclined surface 38 is located intermediate cylinders 3 and 5 in exit segment 23. Surface 38 causes sand S and members M to slide towards dam 25. Openings in dam 25 allow the sand and abrasive members to pass from space 10 in the exit segment into space 10 in the entrance segment. Vanes 9 in the entrance segment, intermediate cylinders 3 and 5 in space 10, urge the sand and abrasive members toward entrance 31.

Outer cylinder 3 has perforations 39 at entrance 31 forming, in essence, a substantial length of screen 40. Screen 40 of outer cylinder 3 is surrounded by a casing 41 having a chute 43. Perforations 39 are sized to allow passage of only the sand S therethrough. The returned media M will not pass therethrough. The returned sand S passes through perforations 39 into chute 43 for collection.

A plurality of paddles 45, formed in an annular wheel, extend radially inwardly from inner cylinder 5 at entrance 31. Paddles 45 are surrounded by an outer wall 47 which extends from a radially innermost edge of paddle 45 to outer cylinder 3 and an inner wall 49 which extends only to inner cylinder 5. Inner wall 49 forms an entrance to paddles 45. Helical vane 9 urges abrasive members M into paddle 45, and are carried upwardly thereby, as paddles 45 rotate with drum 1. When members M are at an upper position, they fall from paddle 45 onto inclined chute or vibratory feeder 29 and are reintroduced into drum 1. The perforations 39 thus serve to separate the removed sand S from abrasive members M and to reintroduce members M back into drum 1 for further use in cleaning castings C. This reduces both the time required to separate sand S from members M and the number of members M needed to clean castings. By recycling members M, the number of fresh members M that need to be introduced into drum 1 in any given amount of time can be reduced by the number of members M that have been recycled.

This description is set forth for illustrative purposes only. Variations or modifications to the subject matter of this invention may be apparent to those skilled in the art upon reviewing the subject matter of this disclosure. Such variations or modifications, if within the spirit of this invention, are intended to be encompassed within the scope of the claims attached hereto. For example, although it is preferred that the media recirculating wheel be formed at the entrance to the drum 1, it could be formed anywhere along the entrance segment.

Having thus described the invention, what is claimed and desired to be secured by Letters Patent is:

1. A rotary media drum for use in separating surface disposed core sand from fresh or dirty castings by tumbling said castings in the presence of abrasive members, said drum comprising:

an outer cylinder and an inner cylinder concentric with the outer cylinder, said inner and outer cylinders defining a space therebetween;

a series of helically arranged cast or fabricated vanes provided within said space at least partially between the two cylinders;

an entrance segment wherein the surface disposed mold sand is removed from said castings by tumbling, said entrance segment defining an entrance to said drum, said entrance segment including means provided on said inner cylinder for moving the castings longitudinally therealong, and defining openings through which removed sand may pass an exit segment, said exit segment of the inner cylinder defining a series of openings therethrough providing for the passage of said abrasive members and any residue loosened sand from the castings into the space between the two said cylinders;

means, in the exit segment, in the space defined by said two cylinder, for moving the separated sand and abrasive members towards the space between the cylinders within the entrance segment; and recirculating means proximate the entrance segment for recirculating abrasive members into the drum and used to remove said core sand.

2. The invention of claim 1 wherein said moving means within the second segment comprises an inclined member sloped to direct the sand and abrasive members towards the spacing containing the helical vanes between the cylinders within the entrance segment.

3. The drum of claim 1 wherein said means for recirculating said abrasive members comprises an an annular wheel at said entrance which rotates with said drum, said annular wheel having a plurality of spaced paddles which receive said abrasive members therebetween for lifting said abrasive members upwardly to reintroduce said members into said drum.

4. The drum of claim 3 wherein said annular wheel has an outer wall which extends between a radial inner edge of said paddles and said outer cylinder and an inner wall extending between said radial inner edge of said paddles and said inner cylinder, said inner wall defining an entrance to said annular wheel.

5. The rotary drum of claim 3 further including means for separating said sand from said abrasive members.

6. The rotary drum of claim 5, wherein said sand-/members separating means includes a screen formed in said outer cylinder in said entrance segment.

7. The rotary drum of claim 6 wherein said screen includes a series of perforations, said perforations being sized to allow passage of only said sand.

* * * * *